US006452318B1

(12) United States Patent
Makimoto

(10) Patent No.: US 6,452,318 B1
(45) Date of Patent: Sep. 17, 2002

(54) ELASTIC SUPPORT MEMBER FOR COLOR CRT

(75) Inventor: Shuji Makimoto, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/424,659

(22) PCT Filed: Jun. 30, 1999

(86) PCT No.: PCT/JP99/01631

§ 371 (c)(1),
(2), (4) Date: Nov. 29, 1999

(87) PCT Pub. No.: WO99/50879

PCT Pub. Date: Oct. 7, 1999

(30) Foreign Application Priority Data

Mar. 31, 1998 (JP) ..... 10-086637

(51) Int. Cl.[7] ..... H01J 29/02; H01J 29/07
(52) U.S. Cl. ..... 313/404; 313/407
(58) Field of Search ..... 313/404, 405, 313/406, 407, 284, 292

(56) References Cited

U.S. PATENT DOCUMENTS 3,617,787 A * 11/1971 Plukker ..... 313/292
3,803,436 A 4/1974 Morrell ..... 313/405
5,880,556 A * 3/1999 Makimoto et al. ..... 313/405
6,288,480 B1 * 9/2001 Takano et al. ..... 313/407

FOREIGN PATENT DOCUMENTS

| | | |
|---|---|---|
| EP | 500312 | 8/1992 |
| EP | 782168 | 7/1997 |
| JP | 63-304548 | 12/1988 |
| JP | 10-289665 | 10/1998 |

* cited by examiner

*Primary Examiner*—Michael H. Day
(74) *Attorney, Agent, or Firm*—Pillsbury Winthrop LLP

(57) ABSTRACT

A shadow mask has a rectangular mask body opposed to the phosphor screen of a panel, and a rectangular mask frame attached to a peripheral portion of the mask body, and is supported on the panel by three mask holders such that it can move relative to the panel. Each mask holder has a fixed portion fixed to the mask frame, an engagement portion engaged with side walls of the panel, and a slope portion connecting the fixed portion to the engagement portion with a distance interposed between them. The slope portion of each mask holder has a cross section smaller at its fixed-portion side than at its engagement-portion side, and also has a responsiveness to a displacement in the mask frame due to thermal expansion thereof. This responsiveness is higher at the fixed-portion side than at the engagement-portion side.

11 Claims, 6 Drawing Sheets

ELASTIC SUPPORT MEMBER FOR COLOR CRT

This application is the national phase of international application PCT/JP99/01631 filed Mar. 30, 1999 which designated the U.S.

TECHNICAL FIELD

The present invention relates to a color cathode-ray tube equipped with a shadow mask, and an elastic support member and an elastic support mechanism for the color cathode-ray tube.

BACKGROUND ART

In general, a color cathode-ray tube is provided with an envelope that includes a rectangular face panel having side walls on a peripheral edge portion of an effective section thereof, and a funnel coupled to the side walls of the panel. A phosphor screen comprising three color phosphor layers which are able to emit blue, green and red light is formed on the inner surface of the effective section of the face panel. In the envelope, a rectangular shadow mask is opposed to the inside of the face panel. Further, an electron gun for emitting three electron beams is disposed in the neck of the funnel.

The electron beams emitted from the electron gun are deflected by a deflection device mounted on the outside of the funnel, and horizontally and vertically scan the phosphor screen through the shadow mask, thereby displaying a color image.

The shadow mask is used to sort out the three electron beams from the electron gun and then correctly land them onto the corresponding three color phosphor layers, in order to obtain desired colors. The shadow mask has a substantially rectangular shadow mask body with multiple electron beam passage apertures, and a substantially rectangular mask frame attached to the periphery of the shadow mask body. The mask frame has four side walls. At least three side walls of the mask frame are supported on the corresponding side walls of the face panel by means of elastic support members, so that the mask body opposes to the phosphor screen with a predetermined distance. Each support member has an end portion fixed to the mask frame, and the other end portion engaged with a stud pin which is provided on the inner surface of a corresponding side wall of the face panel.

In the color cathode ray tube as described above, about 80% of the electron beams strike upon the shadow mask. As a result of the striking of the electron beams, the shadow mask is heated and thermally expanded, thereby causing misalignment between the electron beam passage apertures and the phosphor layers. Accordingly, the electron beams having passed through the shadow mask cannot strike on or land on phosphor layers of target colors, with the result that a color image formed on the phosphor screen is degraded in color purity.

To avoid this, a conventional highly fine color cathode-ray tube for a display monitor, for example, uses, as the material of the shadow mask, Invar of a low thermal expansion property which suppresses thermal expansion.

However, it is difficult in light of cost to use expensive Invar as the material of the mask frame as well as the mask body, and therefore iron is usually used for the mask frame. Therefore, when the heat of the mask body has been transmitted to the mask frame, the mask frame made of iron thermally expands much more than the mask body, whereby a peripheral portion of the mask body is pulled by the mask frame, and the electron beam passage apertures are shifted in a radially outward direction with respect to the center of the mask body. Accordingly, the landing position of a beam spot formed by an electron beam, having passed through each electron beam passage aperture is also shifted in a radially outward direction from a corresponding target phosphor layer.

To reduce such a landing shift, the shadow mask is shifted toward the phosphor screen (this shift will hereinafter be referred to as a "ZMF displacement (Z-directional Mask Frame displacement)", wherein the Z-direction is defined as the direction of the tube axis), thereby shifting the landing position of the electron beams on the phosphor layer toward the center of the phosphor screen so as to offset the landing position shift due to the thermal expansion of the mask frame. As a result, an electron beam of an appropriate spot size can be landed on its target phosphor layer, and hence color purity degradation can be suppressed.

U.S. Pat. No. 3,803,436 discloses a method for suppressing color purity degradation as above, used in a color image cathode ray tube, and wherein elastic support members which secure the mask frame to the panel are appropriately shaped.

Specifically, each of the elastic support members is formed by bending a substantially rectangular metal plate, and comprises a fixed portion fixed to the mask frame, an engagement portion having an engagement hole to be engaged with a stud pin projecting from the face panel, and an slope portion extending between the fixed portion and the engagement portion. The metal plate is bent along a first bending line located between the fixed portion and the slope portion, and also along a second bending line located between the slope portion and the engagement portion. The first and second bending lines extend at a predetermined angle to the direction perpendicular to the tube axis of the color image picture tube.

Where such elastic support members are used, when the heat of the mask body has been transmitted to the mask frame, and the mask frame has been thermally expanded, the elastic members are each pressed against the side walls of the panel by the side walls of the mask frame. As a result, each elastic support member is elastically deformed in a direction in which the bent portions are opened, thereby causing the mask frame to be displaced toward the phosphor screen. In accordance with this displacement, the mask body secured to the mask frame moves toward the phosphor screen. This makes the landing position of each electron beam shift toward the center of the phosphor screen, whereby the color purity degradation is reduced.

The ZMF displacement of the elastic support member, which has two bent portions inclined to the tube axis, increases as the inclination angle of the bent portions to the tube axis increases. However, the ZMF displacement will not increase after the inclination angle exceeds about 40°.

In the case of a small-size color cathode-ray tube of about less than 15 inches, color purity degradation due to the thermal expansion of the mask frame can be suppressed using the ZMF displacement obtained when the inclination angle of the bent portions is set at less than 30°. On the other hand, in the case of a larger color cathode-ray tube of 15 inches, 17 inches or more than 17 inches, a ZMF displacement sufficient to suppress color purity degradation cannot be obtained.

DISCLOSURE OF INVENTION

The present invention has been developed to solve the above-described problems, and its object is to provide a color cathode-ray tube in which color purity deterioration due to thermal expansion of a mask frame employed therein can be compensated even when the tube has a large size of 15 inches or more, and also to provide an elastic support member and an elastic support mechanism employed in the color cathode-ray tube for the mentioned purpose.

According to an aspect of the invention, there is provided a color cathode-ray tube comprising:

a panel having a substantially rectangular effective section, and four side walls provided on a peripheral edge portion of the effective section;

a phosphor screen formed on an inner surface of the effective section of the panel;

a shadow mask arranged inside the panel, having a substantially rectangular mask body opposed to the phosphor screen, and also having a substantially rectangular mask frame supporting a peripheral edge portion of the mask body and opposed to the side walls;

a plurality of elastic support members provided between the mask frame and the side walls of the panel and elastically supporting the mask frame on the side walls of the panel, the elastic support members being adapted to displace the mask frame toward the phosphor screen along a tube axis of the color cathode-ray tube when the mask frame thermally expands toward the side walls of the panel; and an electron gun for emitting electron beams toward the phosphor screen through the shadow mask;

wherein each of the elastic support members is formed by bending a substantially rectangular plate along first and second bending lines which extend parallel to each other and inclined to the tube axis, and has a fixed portion fixed to the mask frame and being adjacent to the first bending line, an engagement portion engaged with a corresponding one of the side walls and being adjacent to the second bending line, and a slope portion connecting the engagement portion to the fixed portion, and the slope portion has a responsiveness to a displacement in the mask frame due to thermal expansion of the mask frame, the part of the slope portion, which is close to the first bending line, having a higher responsiveness than the part of the slope portion, which is close to the second bending line.

Preferably, the cross section of each elastic support member, which is in parallel to the first bending line, is smaller at its fixed-portion side than at its engagement-portion side.

In the color cathode-ray tube constructed as described above, the responsiveness of the slope portion of each elastic support member to a displacement in the mask frame due to thermal expansion thereof caused by the heating of the shadow mask is smaller at its engagement-portion side than at its fixed-portion side. Accordingly, when each elastic support member is compressed by the expanded mask frame, the fixed-portion side of the slope portion more greatly deforms than the engagement-portion side thereof, thereby displacing the shadow mask toward the phosphor screen. As a result, the displacement of the shadow mask relative to the phosphor screen, caused by the thermal expansion of the mask frame, can be corrected, thereby compensating the color purity degradation of the image displayed on the phosphor screen.

Such a responsiveness-to-displacement as above can be imparted to each elastic support member when each elastic support member is formed such that the cross section of the slope portion which is parallel to the bending line of a bending portion is smaller at its fixed-portion side than at its engagement-portion side. Further, the responsiveness to displacement can be also obtained by setting longer the one of two bending portions defining the slope portion, which is close to the engagement portion, than the other of the two bending portions, which is close to the fixed portion.

According to another aspect of the invention, there is provided an elastic support member incorporated in a color cathode-ray tube which includes a panel having a substantially rectangular effective section, and four side walls provided on a peripheral edge portion of the effective section, a phosphor screen formed on an inner surface of the effective section of the panel, a shadow mask arranged inside the panel, having a substantially rectangular mask body opposed to the phosphor screen, and also having a substantially rectangular mask frame supporting a peripheral edge portion of the mask body and opposed to the side walls, the elastic support member elastically supporting the shadow mask on the side walls of the panel, comprising:

a fixed portion fixed to the mask frame; an engagement portion engaged with a corresponding one of the side walls; and a slope portion having opposite bent portions which are inclined to a tube axis of the color cathode-ray tube and connecting the fixed portion and the engagement portion to each other with a step therebetween;

the slope portion having a responsiveness to a displacement in the mask frame due to thermal expansion of the mask frame, the responsiveness being higher at a fixed-portion side of the slope portion than at an engagement-portion side thereof.

Preferably, the cross section of the slope portion of each elastic support member, which is parallel to the bent portions, is smaller at its fixed-portion side than at its engagement-portion side.

When the elastic support members, constructed as above, for use in the color cathode-ray tube have been compressed by the mask frame as a result of its thermal expansion, the part of the slope portion, which is close to the fixed portion, is more greatly displaced than the part thereof close to the engagement portion by virtue of the responsiveness-to-displacement of the slope portion. This corrects relative displacement of the shadow mask to the phosphor screen due to the thermal expansion of the mask frame, thereby compensating color purity deterioration of the phosphor screen.

Moreover, in each elastic support member according to the invention, the fixed-portion has a projection projecting from one of the bending portion which is close to the fixed portion, along the axis of the color cathode-ray tube. This projection facilitates the fixing of the fixed portion to the mask frame.

According to a yet another aspect of the invention, there is provided an elastic support mechanism incorporated in a color cathode-ray tube which includes a panel having a substantially rectangular effective section, and four side walls provided on a peripheral edge portion of the effective section, a phosphor screen formed on an inner surface of the effective section of the panel, a shadow mask arranged inside the panel, having a substantially rectangular mask body opposed to the phosphor screen, and also having a substantially rectangular mask frame supporting a peripheral edge portion of the mask body and opposed to the side walls, the elastic support mechanism elastically supporting the shadow mask on the side walls of the panel, comprising:

a stud pin provided on an inner surface of each of at least three of the side walls; and an elastic support member provided between each of the at least three of the side walls and the mask frame.

Each elastic support member includes a fixed portion fixed to the mask frame; an engagement portion engaged with a corresponding one of the side walls; and a slope portion having opposite bent portions which are inclined to a tube axis of the color cathode-ray tube and connecting the fixed portion and the engagement portion to each other with a step therebetween.

The slope portion has a responsiveness to a displacement in the mask frame due to thermal expansion of the mask frame, the responsiveness being higher at a fixed-portion side of the slope portion than at an engagement-portion side thereof.

BEST MODE OF CARRYING OUT THE INVENTION

A color cathode-ray tube according to the embodiment of the invention will be described in detail with reference to the accompanying drawings.

Figure 1:
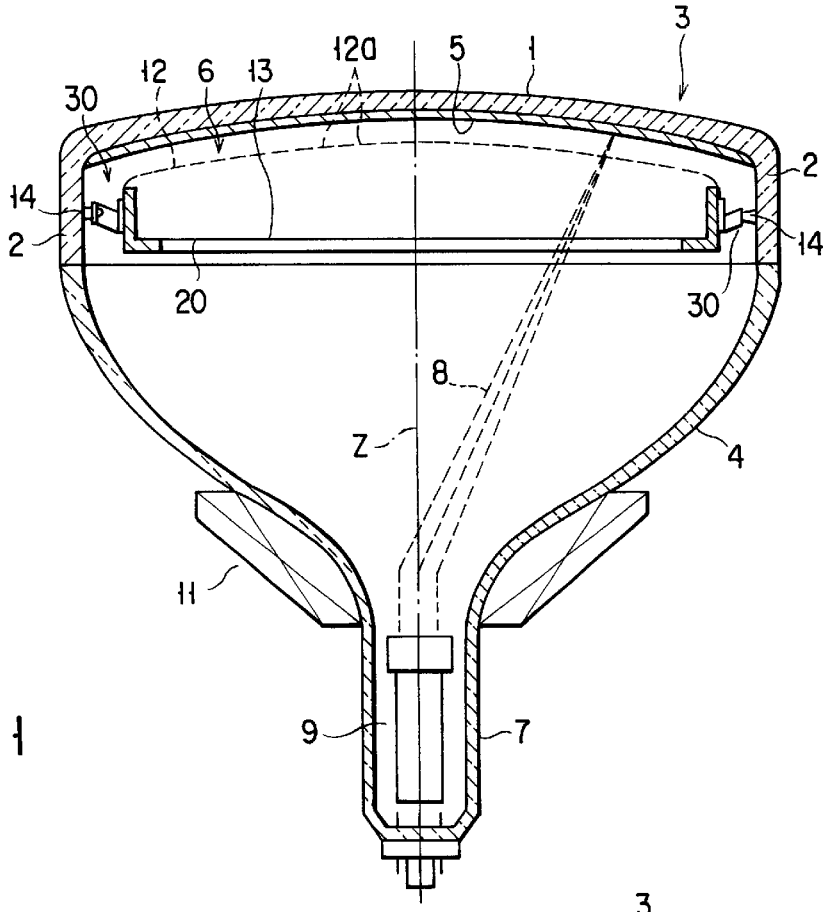
FIG. 1 is a longitudinal sectional view illustrating a color cathode-ray tube according to the embodiment of the present invention.
Figure 2:
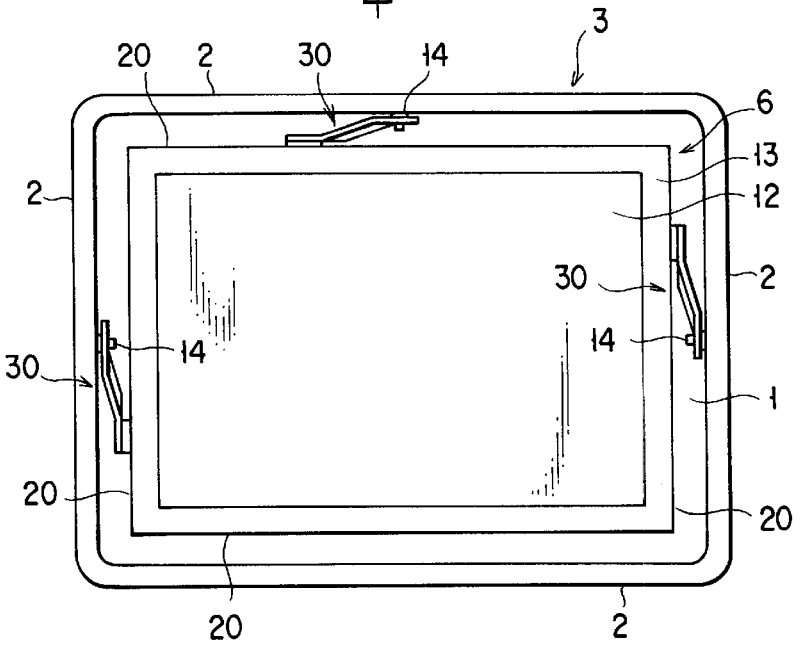
FIG. 2 is a front view illustrating a panel and a shadow mask incorporated in the color cathode-ray tube and, seen from the electron gun side thereof.

Referring first to FIGS. 1 and 2, the color cathode-ray tube is provided with a vacuum envelope 10, which comprises a substantially rectangular glass panel 3 and a funnel 4. The panel 3 has a substantially rectangular effective section 1, and four side walls 2 placed along a peripheral edge portion of the effective section 1. The funnel 4 is fixed to the side walls 2. A tapered stud pin 14 protrudes inward from a center portion of the inner surface of each of three side walls 2.

A phosphor screen 5 formed of three-color phosphor layers, which are able to emit blue, green and red light, is formed on the inner surface of the effective section 1 of the panel 3. A substantially rectangular shadow mask 6 is arranged inside the panel 3 such that it is opposed to the phosphor screen 5 with a predetermined space therebetween.

Located inside the neck 7 of the funnel 4 is an electron gun 9 that emits three electron beams 8. The electron gun 9 is located along the axis of the panel 3, i.e. coaxial with the tube axis Z. The three electron beams 8 emitted from the electron gun 9 are deflected by a deflecting device 11, which is mounted on the outside of the funnel 4, and scan the phosphor screen 5 horizontally and vertically through the shadow mask 6. Thus, a color image is displayed on the screen 5.

Figure 3:
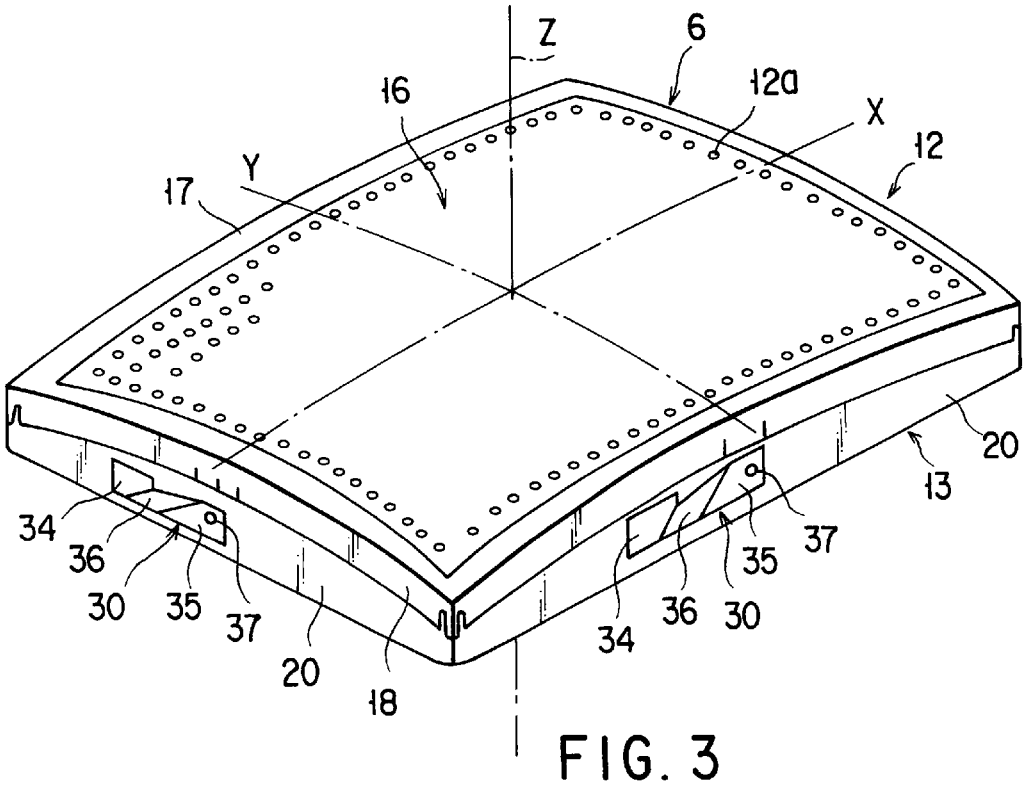
FIG. 3 is a perspective view of the shadow mask of the color cathode-ray tube.

As is shown in FIGS. 1 to 3, the shadow mask 6 having a color selecting function includes a substantially rectangular mask body 12 formed with a number of electron beam passage apertures 12*a,* and a rectangular mask frame 13 supporting the peripheral edge of the mask body. The mask body 12 has a rectangular effective portion 16 provided with the electron beam passage apertures 12*a,* a non-aperture portion 17 surrounding the effective section, and a skirt portion 18 extending from the periphery of the non-aperture portion in the direction parallel to the tube axis Z which is perpendicular to the center of the effective portion 16. The mask body is made of Invar (thermal expansion coefficient: $1.2\times10^{6}$/°C.).

The panel 4 and the shadow mask 6 have a long axis (horizontal axis) X and a short axis (vertical axis) Y which are perpendicular to each other and pass through the tube axis Z.

The mask frame 13 has four walls 20, which extend along the center axis of the panel 3, i.e. the tube axis Z of the color cathode-ray tube, and are opposed to the side walls of the panel 3 with a predetermined space therebetween. Each wall 20 has an L-shaped cross section. The three walls 20 of the mask body 12 are supported by the panel 3 by means of mask holders 30 each of which serve as an elastic support member constituting an elastic support mechanism, such that it is opposed to the phosphor screen 5 with a predetermined space therebetween.

Figure 4:
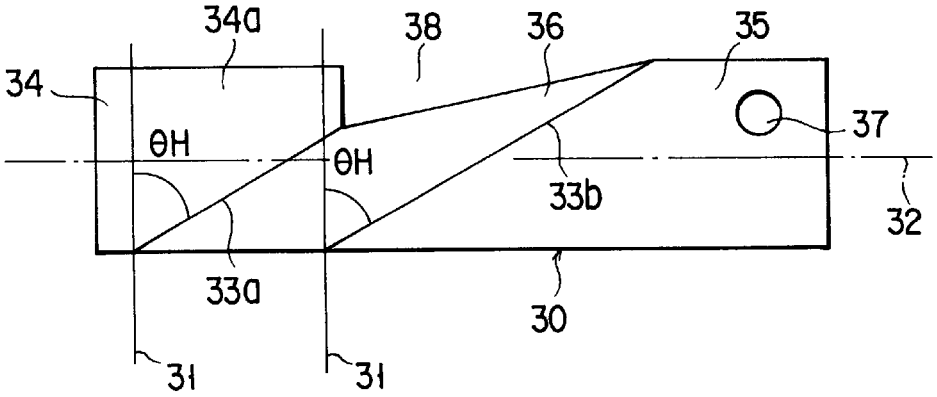
FIG. 4 is a plan view, showing the shape of a mask holder for holding the shadow mask before the holder is bent.
Figure 5:
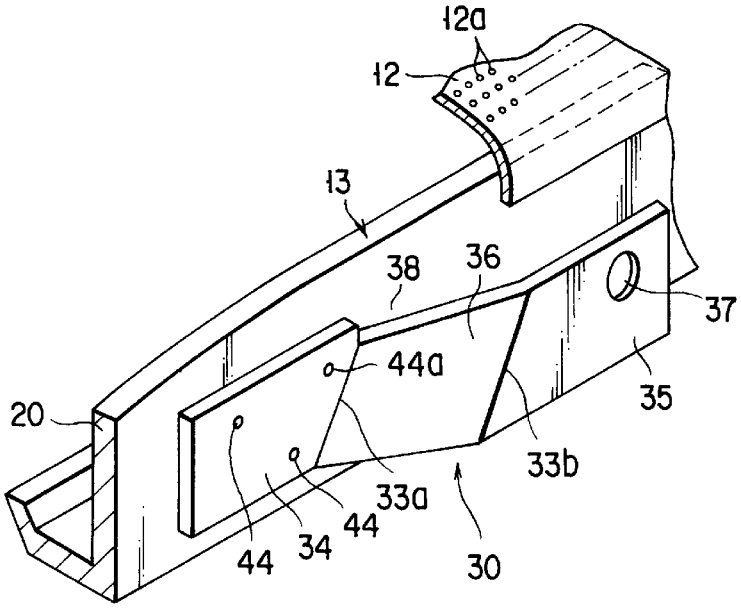
FIG. 5 is a perspective view of the mask holder.
Figure 6A:
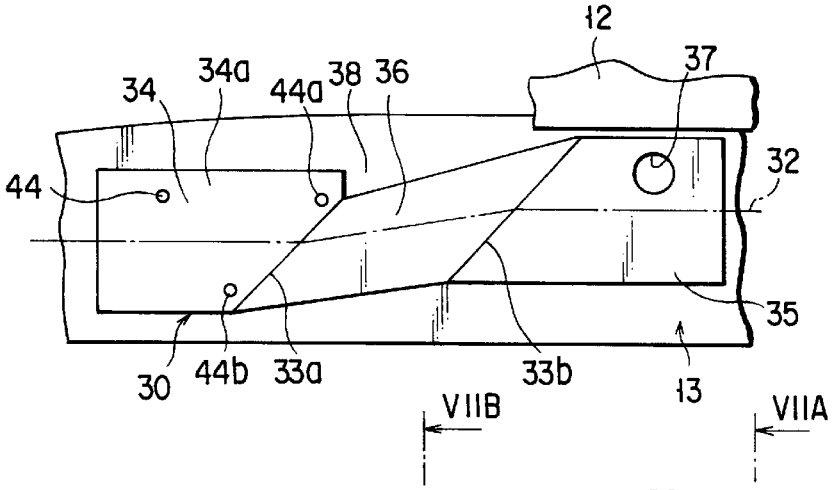
FIG. 6A is a front view of the mask holder.
Figure 6B:
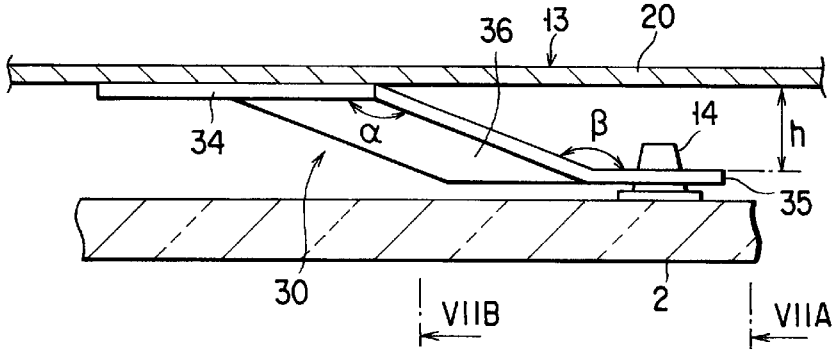
FIG. 6B is a plan view of the mask holder.
Figure 7A:
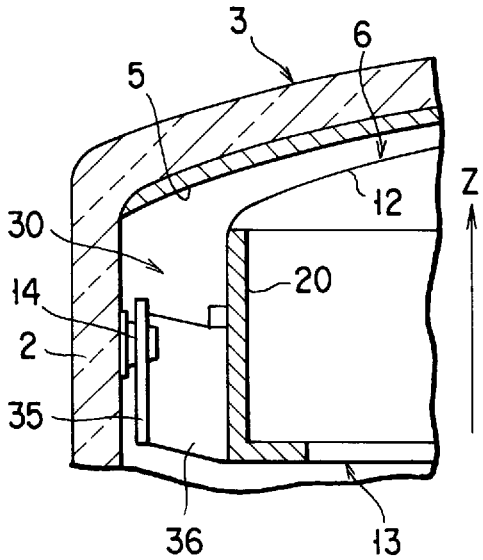
FIG. 7A is a sectional view taken along lines VIIA—VIIA of FIG. 6B.
Figure 7B:
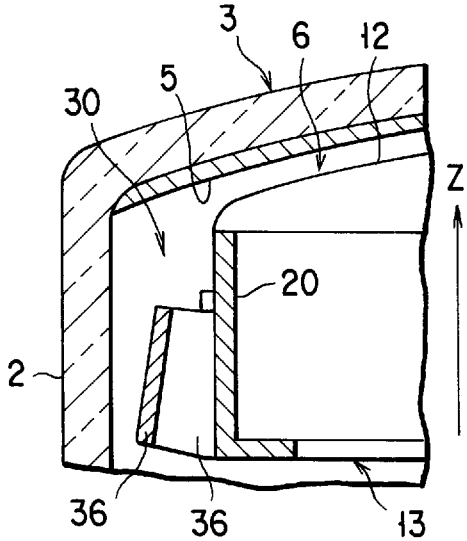
FIG. 7B is a sectional view taken along lines VIIB—VIIB of FIG. 6B.

As is shown in FIGS. 4 to 6B, each mask holder 30 is formed by bending an elongate, rectangular, metal plate, and made of a material which has a lower thermal expansion coefficient than the material of the mask frame 13, for example, stainless steel. FIG. 4 shows the state of the mask holder 30 assumed before it is bent, while FIGS. 5 to 6B show the state of the holder assumed after it is bent.

More specifically, the holder 30 is bent at two portions along two parallel lines, i.e. first and second bending lines 33*a* and 33*b,* that are inclined at an angle θH (θH<90°) to a line perpendicular to its longitudinal center line 32, i.e. to a line 31 parallel to the tube axis Z. The angle OH is set at, for example, 49°. The bending directions of the mask holder 30 along the first and second bending lines 33*a* and 33*b* are opposite to each other, while the bending angle α (β) is greater than 90°.

As a result of the bending at the two portions, the mask holder 30 has a fixed portion 34 located on a longitudinal one end side, an engagement portion 35 located on the other longitudinal end side, and a slope portion 36 extending between the fixed portion 34 and the engagement portion 35, i.e. between the first and second bending lines 33*a* and 33*b*.

The fixed portion 34 and the engagement portion 35 extend substantially parallel to each other with a predetermined distance h therebetween. The engagement portion 35 has a substantially circular through hole 37.

A wedged recess 38 is formed at an upper edge of the slope portion 36 of the mask holder 30, as shown in FIGS. 4, 5 and 6A. Accordingly, the bending line 33*a* between the fixed portion 34 and the slope portion 36 is shorter than the bending line 33*b* between the slope portion 36 and the engagement portion 35. In other words, the slope portion 36 is formed such that a cross section thereof parallel to the bending lines 33*a* and 33*b* is smallest at the first bending line 33*a,* and gradually increases from its fixed-portion 34 side to its engagement-portion 35 side.

Thus, the mask holder 30 is constructed such that the bent portion along the first bending line 33*a* is more deformable than the bent portion along the second bending line 33*b,* and such that the responsiveness-to-displacement of the slope portion 36 is higher at its fixed-portion 34 side than at its engagement-portion 35 side.

Further, the fixed portion 34 has a projection 34*a* upwardly projecting from the first bending line 33*a* along the tube axis Z.

As is shown in FIGS. 5 to 7B, each mask holder 30 constructed as described above is attached to the shadow mask 6 with its fixed portion 34 being fixed to a corresponding one of the walls 20 of the mask frame 13, and is also engaged with the panel 20 with the through hole 37 of its engagement portion 35 being engaged with a corresponding stud pin 14. Moreover, each mask holder 30 is fixed to the mask frame 13 such that the center line 32 of its fixed portion 34 is in parallel to the longitudinal center line of the corresponding wall 20 of the mask frame 13.

The fixed portion 34 is fixed to the wall 20 of the mask frame 13, with a plurality of points thereof (e.g. three points) spot-welded to the wall. Two weld spots 44*a* and 44*b* of the three weld spots 44 are located adjacent to the opposite ends of the first bending line 33*a*.

In this state, the fixed portion 34 and the engagement portion 35 of each mask holder 30 extend substantially in parallel to each other, and are opposed substantially in parallel to the corresponding wall 20 of the mask frame 13 and the corresponding side wall 2 of the panel 3.

Since the mask holder 30 is bent along the pair of bending lines 33*a* and 33*b* which incline by the angle θH with respect to the line 31 parallel to the tube axis Z, i.e. which incline upward to the right in FIG. 6A, the engagement portion 35 is engaged with the stud pin 14 in a position closer to the phosphor screen 5 than the fixed portion 35 with respect to the tube axis Z. Further, as is understood from FIG. 7B, the slope portion 36 inclines to the tube axis Z, and also to two lines which are perpendicular to each other and to the tube axis Z.

The stud pins 14 are provided at longitudinal central portions of the three side walls 2 of the panel 3, respectively. Accordingly, the mask holders 30 are fixed to the mask frame 13 such that the through holes 37 formed in the engagement portions 35 are opposed to the respective longitudinal central portions of the three walls 20 of the mask frame 13, as shown in FIG. 2.

A description will now be given of the operation of the color cathode-ray tube having the above mentioned construction to correct the degradation of color purity due to the thermal expansion of the mask frame, using the mask holders 30.

Figure 8A:
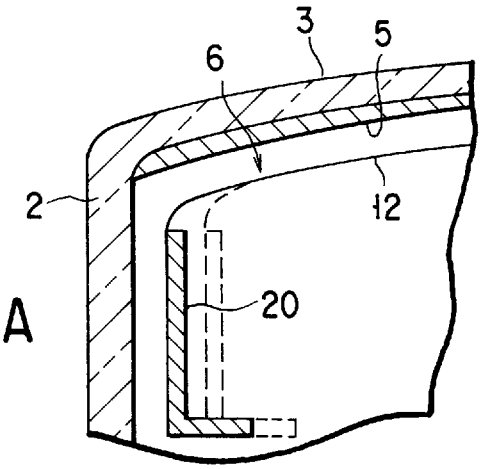
FIG. 8A is a sectional view showing a state in which the mask frame is thermally expanded.

While the color cathode-ray tube is operated, the mask body 12 is heated as a result of the striking of electron beams thereon. The heat of the mask body 12 is transmitted to the mask frame 13, whereby the mask frame 13 thermally expands, and each wall 20 is displaced from a position indicated by the broken line toward a corresponding side wall 2 of the panel 3, as shown in FIG. 8A. At this time, the mask body 12 is pulled by the mask frame 13 and displaced in the same direction.

Figure 8B:
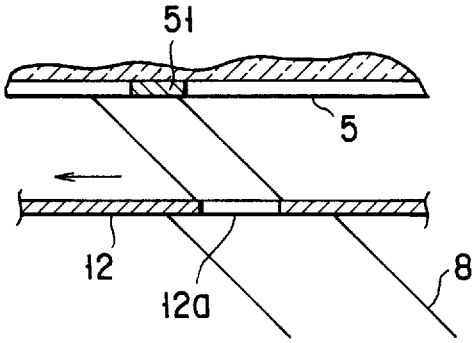
FIG. 8B is a schematic view showing a state in which the electron beam landing position is shifted due to the thermal expansion of the mask frame.

Further at this time, the electron beam passage apertures 12*a* of the mask body 12 move radially outwardly relative to the phosphor screen 5 as shown in FIG. 8B, with the result that each electron beam 8 having passed through a corresponding beam passage aperture 12*a* lands on that portion of the phosphor screen 5 which is radially outwardly deviated from a target phosphor layer 51. This is the cause of the deterioration of color purity.

Figure 8C:
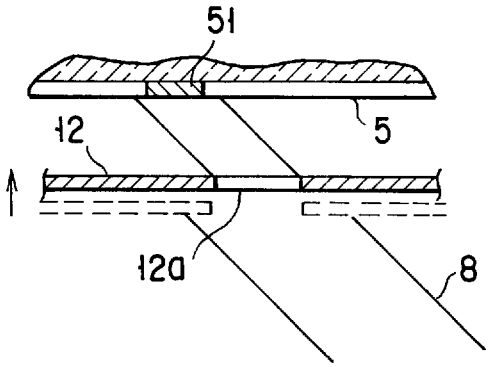
FIG. 8C is a schematic view showing the movement of the shadow mask necessary to correct the electron beam landing shift.

To avoid the deterioration of color purity, the mask holders 30 move the mask body 12 toward the phosphor screen 5 from a normal position indicated by the broken line to a correcting position indicated by the solid line in FIG. 8C, thereby correcting the landing positions of the electron beams 8 to the target phosphor layers 51. The responsiveness of the slope portion 36 of each mask holder 30 to the displacement in the mask frame 13 caused by the thermal expansion of the mask body 4 is higher at the fixed portion 34 side than at the engagement portion 35 side. Using this property of the slope portion 36, each mask holder 30 compensates a displacement of the mask body 12 relative to the phosphor screen 5 due to the thermal expansion of the mask frame 13.

Figure 9A:
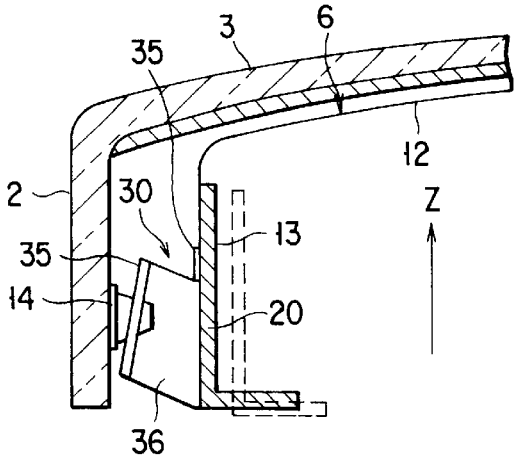
FIGS. 9A to 9C are sectional, side and sectional views showing the operations of the mask holder performed when the mask frame has been thermally expanded.

More specifically, when the mask frame 13 thermally expands during the operation of the color cathode-ray tube, the distance between the walls 20 of the mask frame 13 and the side walls 2 of the panel 3 is narrowed, the respective mask holders 30 between the walls 20 and the side walls 2 are compressed as shown in FIG. 9A. As a result, each mask holder 30 deforms such that the angle a between the fixed portion 34 and the slope portion 36 and the angle β between the engagement portion 35 and the slope portion 36 increase.

Figure 9C:
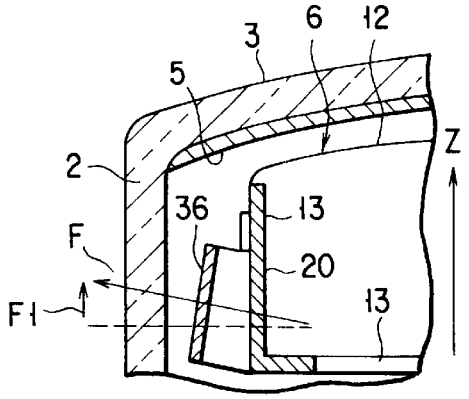
Figure 9B:
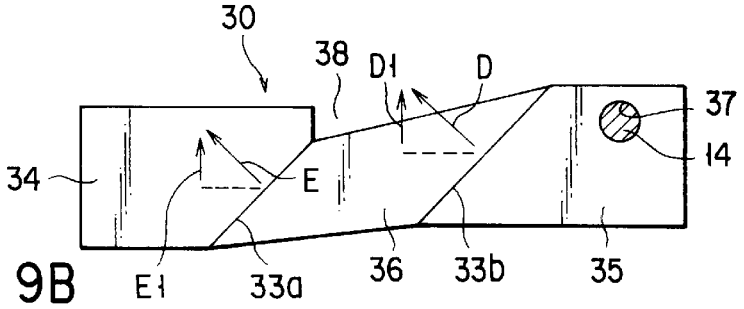

The engagement portion 35 of the mask holder 30 is fixedly engaged with the stud pin 14, and therefore the slope portion 36 is displaced in a direction D perpendicular to the second bending line 33*b* with respect to the engagement portion 35, while the fixed portion 34 is displaced in a direction E perpendicular to the first bending line 33*a* with respect to the slope portion 36, as is shown in FIG. 9B. Since the directions D and E contain Z-directional components D1 and E1, respectively, the slope portion 36 and the fixed portion 34 are displaced toward the phosphor screen 5 along the tube axis Z.

Moreover, when the mask holders 30 are compressed, the slope portion 36 is warped. This warping force causes the slope portion 36 to move in a direction F perpendicular to the surface thereof, as shown in FIG. 9C. Since the slope portion 36 inclines to the tube axis Z, the F-directional displacement contains a Z-directional component Fl. Accordingly, when the slope portion 36 is warped, the fixed portion 34 is displaced toward the phosphor screen 5 along the tube axis Z.

As a result, the shadow mask 6 supported by the mask holders 30 is displaced toward the phosphor screen 5 along the tube axis Z, thereby displacing the landing position of the electron beam toward the center of the phosphor screen and reducing the degree of the color purity deterioration.

Since as described above, the responsiveness-to-displacement of the slope portion 36 of each mask holder 30 is higher at the fixed portion 34 side than at the engagement portion 35 side, when the mask holders have been compressed as a result of the thermal expansion of the mask frame 13, the bent portion of the slope portion 36 along the first bending line 33*a* more greatly elastically deforms than the bent portion thereof along the second bending line 33*b*, with the result that the fixed portion 34 more greatly displaces toward the phosphor screen along the tube axis Z.

Figure 10:
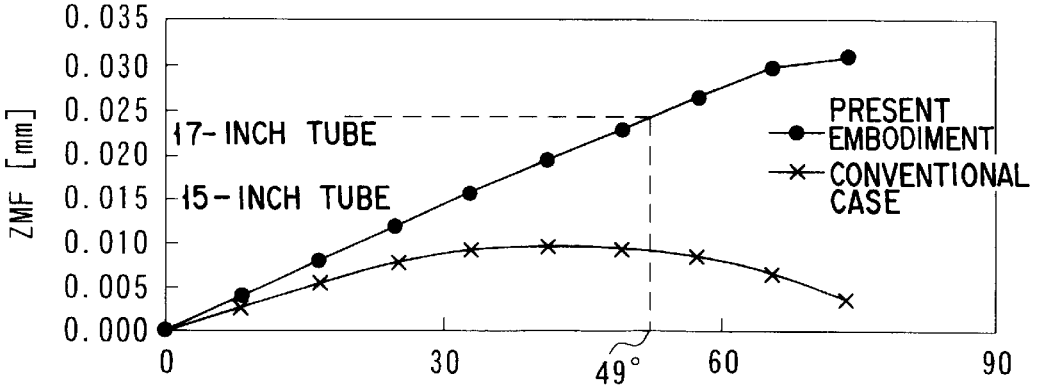
FIG. 10 is a graph showing the relationship between the inclination angles of the bent portions of the mask holder of the embodiment and the conventional mask holder, and displacements of the mask frame in the direction of the tube axis.
Figures 11A, 11B, 11C, 11D, 11E:
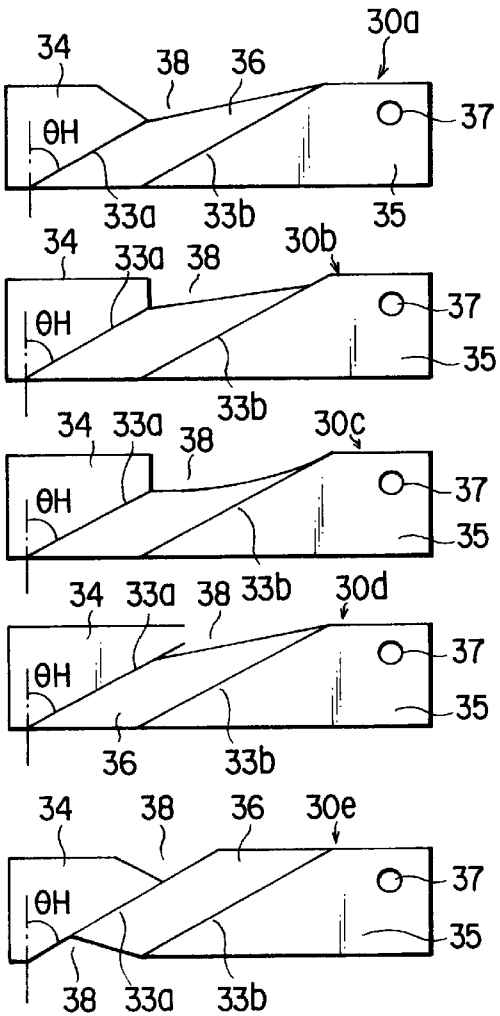
FIGS. 11A to 11J are side views showing mask holders according to 10 modifications of the invention.
Figures 11F, 11G, 11H, 11I, 11J:
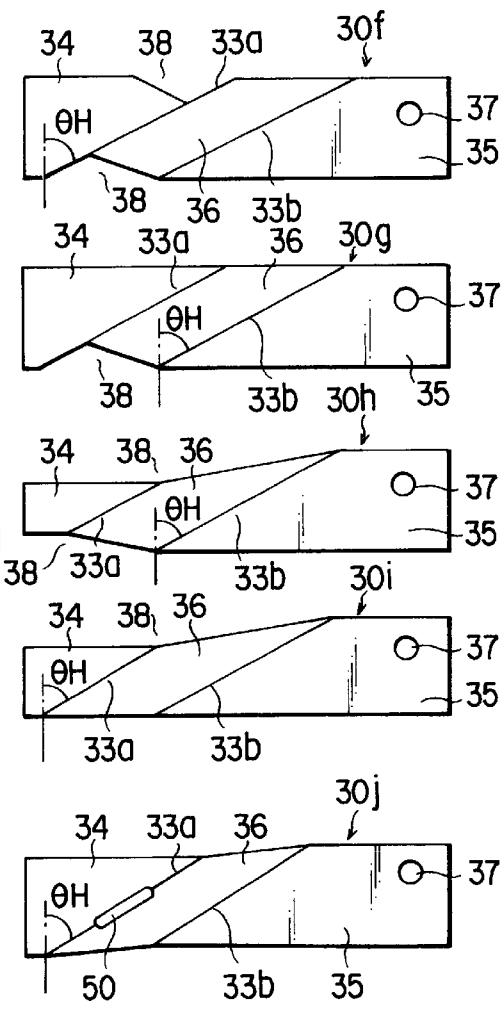

The displacement of each mask holder 30, when compressed, varies substantially linearly because of the responsiveness-to-displacement of the slope portion 36. In addition, when the inclination angle θH of the first and second bending lines 33*a* and 33*b* is varied, the ZMF shift of the mask holder 30 linearly increases with an increase in the angle OH over a wide angle range, as is indicated by the black dots in FIG. 10. In FIG. 10, the curve marked with crosses (x) indicates the property of a conventional mask holder. As is evident from the curve, the ZMF displacement decreases when the angle θH exceeds about 30° in the conventional mask holder.

Thus, the mask holder 30 constructed as described above enables realization of a desired ZMF displacement corresponding to the inclination angle θH, and effective compensation of color purity deterioration due to the thermal expansion of the mask frame 13.

In other words, since the mask holder 30 as an elastic support member is constructed as above, the shadow mask 6 can be linearly displaced along the tube axis X by varying, in accordance with the size of the phosphor screen, the inclination angle θH of the first and second bending lines 33*a* and 33*b* which define the slope portion 36 of the mask holder 30. Therefore, even when the mask holders 30 are applied to a cathode-ray tube with a large size of 15 inches or more, a sufficient ZMF displacement can be obtained, and hence the color purity degradation of the phosphor screen can be compensated.

For example, in a 17-inch conventional color cathode-ray tube, the maximum landing displacement (PD) due to the thermal expansion of the mask frame 13 was about 0.020 mm at a diagonally outermost portion of the screen. In this case, the incidence angle θB of the electron beam at the shadow mask is about 40°, and the ZMF displacement necessary to correct the landing displacement is 0.024 mm (=PD/tan(θB)=0.020/tan(40°)).

When using the mask holders 30 of the present invention, the ZMF displacement of 0.024 mm is obtained when the inclination angle θH is 49°, as is understood from FIG. 10. Thus, the mask holders 30 can completely correct the landing displacement of the electron beam due to the thermal expansion of the mask frame 13.

On the other hand, in the case of using the conventional elastic support members, the maximum ZMF displacement is only 0.010 mm (at θH=30°) from FIG. 10, which means that the electron beam landing displacement cannot be corrected when those elastic members are applied to a 17-inch cathode-ray tube.

It is clear that the mask holder 30 of the present embodiment can provide a ZMF displacement twice or more the conventional one. Further, as is evident from FIG. 10, the mask holders 30 of the present embodiment can provide a ZMF displacement sufficient to correct the landing displacement by increasing the inclination angle θH, even in the case of a cathode-ray tube larger than 17 inches.

As described above, with the color cathode-ray tube, having the mask holders 30 constituting the elastic support mechanism, color purity deterioration due to the thermal expansion of the mask frame can compensate, and hence enhance the image quality, even in a large cathode-ray tube of 15 inches or more.

Mask holders 30*a* to 30*j* shown in FIGS. 11A to 11J, according to modifications of the above-described mask holder 30, may be used as elastic support members in place of the above-mentioned mask holder 30. These mask holders 30*a* to 30*j* have a similar basic structure to the above-described mask holder 30 and can provide the same advantages.

Each of the mask holders 30*a* to 30*j* is formed by bending a substantially rectangular metal plate along first and second bending lines 33*a* and 33*b*, and has a fixed portion 34, an engagement portion 35, and a slope portion 36 connecting the fixed portion 34 to the engagement portion 35. The first and second bending lines 33*a* and 33*b* extend at an angle θH to the tube axis. The slope portion 36 is shaped such that a cross section thereof parallel to the bending lines 33*a* and 33*b* is smallest at the first bending line 33*a*, and gradually increases from its fixed-portion 34 side to its engagement-portion 35 side.

As a result, each of the mask holders 30 is constructed such that the bent portion along the first bending line 33*a* is more deformable than the bent portion along the second bending line 33*b*, and the responsiveness-to-displacement of the slope portion 36 is higher at the fixed-portion 34 side than at the engagement-portion 35 side.

In the mask holders 30*a* to 30*i*, the first bending line 33*a* between the fixed portion 34 and the slope portion 36 is shorter than the second bending line 33*b* between the slope portion 36 and the engagement portion 35.

The mask holders 30*a* to 30*d* and 30*i* have only a recess 38 formed at the upper edge thereof. These recesses 38 have shapes different from the recess 38 of the above-described mask holder 30.

The mask holders 30*e*, 30*f* and 30*h* have recesses 38 formed at the upper and lower edges thereof. The mask holder 30*g* has a recess 38 formed only at the lower edge thereof.

In the mask holders 30*a* to 30*d*, 30*f* and 30*g*, the fixed portion 34 has the same width as the engagement portion 35 and hence is large to some extent. Accordingly, a welding area sufficient to weld the mask holder to the mask frame 13 can be secured, thereby facilitating the welding process. On the other hand, in the mask holders 30*e*, 30*h* and 30*i*, the fixed portion 34 has a smaller width than the engagement portion 35.

Concerning the mask holder 30*j*, it has a similar outward appearance to the conventional elastic support member. In this case, however, an elongate hole 50 is formed on and along the first bending line 33*a*, which is the border between the fixed portion 34 and the slope portion 36. Since this elongate hole reduces the mechanical strength of the bent portion around it, the aforementioned responsiveness-to-displacement is also realized in the mask holder 30*j*.

The present invention is not limited to the above-described embodiment, but can be modified in various manners without departing from its scope. For example, to compensate color purity deterioration which occurs while the ambient temperature increases, a bimetal may be interposed between the fixed portion of each mask holder and the mask frame. Also, the elastic support mechanism including the mask holders may be provided on all of the four side walls of the mask frame, instead of on only three of them.

In addition, the first and second bending lines of the mask holder may not always be parallel to each other, but may be set to have different inclination angles θH when necessary.

Industrial Applicability

According to the present invention, there can be provided a color cathode-ray tube, and an elastic support member and an elastic support mechanism for the color cathode-ray tube in which the displacement of the shadow mask relative to the phosphor screen, caused by the thermal expansion of the mask frame, can be corrected, thereby compensating the color purity degradation of the image displayed on the phosphor screen.

What is claimed is:

1. A color cathode-ray tube comprising:

a panel having a substantially rectangular effective section, and four side walls provided on a peripheral edge portion of the effective section;

a phosphor screen formed on an inner surface of the effective section of the panel;

a shadow mask arranged inside the panel, having a substantially rectangular mask body opposed to the phosphor screen, and also having a substantially rectangular mask frame supporting a peripheral edge portion of the mask body and opposed to the side walls;

a plurality of elastic support members provided between the mask frame and the side walls of the panel and elastically supporting the mask frame on the side walls of the panel, the elastic support members being adapted to displace the mask frame toward the phosphor screen along a tube axis of the color cathode-ray tube when the mask frame thermally expands toward the side walls of the panel; and an electron gun for emitting electron beams toward the phosphor screen through the shadow mask;

wherein each of the elastic support members is formed by bending a substantially rectangular plate along first and second bending lines which extend substantially in parallel to each other and inclined to the tube axis, and has a fixed portion fixed to the mask frame and being adjacent to the first bending line, an engagement portion engaged with a corresponding one of the side walls and being adjacent to the second bending line, and a slope portion connecting the engagement portion to the fixed portion, the first bending line being shorter than the second bending line, and the slope portion has a responsiveness to a displacement in the mask frame due to thermal expansion of the mask frame, the part of the slope portion, which is close to the first bending line, having a higher responsiveness than the part of the slope portion, which is close to the second bending line.

2. A color cathode-ray tube according to claim 1, wherein the slope portion has a responsiveness which gradually reduces from its first-bending-line side to its second-bending-line side.

3. A color cathode-ray tube according to claim 1, wherein the cross section of the slope portion, which is close and parallel to the first bending line, is smaller than the cross section of the slope portion, which is close and parallel to the second bending line.

4. A color cathode-ray tube according to claim 3, wherein the slope portion has a cross section which gradually reduces from its first-bending-line side to its second-bending-line side.

5. A color cathode-ray tube according to claim 3, wherein each of the elastic support members has an elongate hole formed on and along the first bending line.

6. A color cathode-ray tube according to claim 1, wherein the first and second bending lines extend parallel to each other.

7. An elastic support member incorporated in a color cathode-ray tube which includes a panel having a substantially rectangular effective section, and four side walls provided on a peripheral edge portion of the effective section, a phosphor screen formed on an inner surface of the effective section of the panel, a shadow mask arranged inside the panel, having a substantially rectangular mask body opposed to the phosphor screen, and also having a substantially rectangular mask frame supporting a peripheral edge portion of the mask body and opposed to the side walls, the elastic support member elastically supporting the shadow mask on the side walls of the panel, comprising:

a fixed portion fixed to the mask frame; an engagement portion engaged with a corresponding one of the side walls; and a slope portion having opposite bent portions which are inclined to a tube axis of the color cathode-ray tube and connecting the fixed portion and the engagement portion to each other with a step therebetween, the bent portion at the fixed-portion side being shorter than the bent portion at the engagement-portion side;

the slope portion having a responsiveness to a displacement in the mask frame due to thermal expansion of the mask frame, the responsiveness being higher at a fixed-portion side of the slope portion than at an engagement-portion side thereof.

8. An elastic support member according to claim 7, wherein the cross section of the slope portion, which is parallel to the opposite bent portions, is smaller at the fixed-portion side than at the engagement-portion side.

9. An elastic support member according to claim 7, wherein the fixed-portion has a projection projecting from one of the bending portion which is close to the fixed portion, along the tube axis of the color cathode-ray tube.

10. An elastic support mechanism incorporated in a color cathode-ray tube which includes a panel having a substantially rectangular effective section, and four side walls provided on a peripheral edge portion of the effective section, a phosphor screen formed on an inner surface of the effective section of the panel, a shadow mask arranged inside the panel, having a substantially rectangular mask body opposed to the phosphor screen, and also having a substantially rectangular mask frame supporting a peripheral edge portion of the mask body and opposed to the side walls, the elastic support mechanism elastically supporting the shadow mask on the side walls of the panel, comprising:

a stud pin provided on an inner surface of each of at least three of the side walls; and an elastic support member provided between each of the at least three of the side walls and the mask frame, each of the elastic support members including a fixed portion fixed to the mask frame; an engagement portion engaged with a corresponding one of the side walls; and a slope portion having opposite bent portions which are inclined to a tube axis of the color cathode-ray tube and connecting the fixed portion and the engagement portion to each other with a step therebetween, the bent portion at the fixed-portion side being shorter than the bent portion at the engagement-portion side;

each of the slope portions having a responsiveness to a displacement in the mask frame due to thermal expansion of the mask frame, the responsiveness being higher at a fixed-portion side of the slope portion than at an engagement-portion side thereof.

11. An elastic support mechanism according to claim 10, wherein the cross section of the slope portion of each elastic support member, which is in parallel to the opposite bent portions, is smaller at the fixed-portion side than at the engagement-portion side.

* * * * *

UNITED STATES PATENT AND TRADEMARK OFFICE

CERTIFICATE OF CORRECTION

PATENT NO. : 6,452,318 B1
DATED : September 17, 2002
INVENTOR(S) : Makimoto

It is certified that error appears in the above-identified patent and that said Letters Patent is hereby corrected as shown below:

Title page,
Item [22], PCT Filed: please change "Jun. 30, 1999" to -- Mar. 30, 1999 --.

Signed and Sealed this

Twenty-fifth Day of November, 2003

JAMES E. ROGAN
*Director of the United States Patent and Trademark Office*